US006948221B2

(12) United States Patent
Fuchs

(10) Patent No.: US 6,948,221 B2
(45) Date of Patent: Sep. 27, 2005

(54) APPARATUS FOR NEEDLING A NON-WOVEN MATERIAL

(75) Inventor: Helmut Fuchs, Linz (AT)

(73) Assignee: Textilmaschinenfabrik Dr. Ernst Fehrer Aktiengesellschaft, Leonding (AT)

( * ) Notice: Subject to any disclaimer, the term of this patent is extended or adjusted under 35 U.S.C. 154(b) by 163 days.

(21) Appl. No.: 10/874,057

(22) Filed: Jun. 22, 2004

(65) Prior Publication Data

US 2005/0011060 A1 Jan. 20, 2005

(30) Foreign Application Priority Data

Jul. 15, 2003 (AT) ..... A 1090/2003

(51) Int. Cl.[7] ..... D04H 18/00
(52) U.S. Cl. ..... 28/107; 28/114
(58) Field of Search ..... 28/107, 114, 108–113, 28/115, 142, 165, 103–105, 159–162; 198/804, 806, 807; 112/80.32, 2.2, 80.31

(56) References Cited

U.S. PATENT DOCUMENTS 4,651,393 A * 3/1987 Dilo et al. ..... 28/111
5,058,249 A * 10/1991 Leuchtenmuller ..... 28/109
5,144,730 A * 9/1992 Dilo ..... 28/109
5,387,454 A * 2/1995 Werner ..... 428/85
5,390,399 A * 2/1995 Dilo ..... 28/109
5,707,906 A * 1/1998 Eschenbach ..... 442/411
5,758,394 A * 6/1998 Linck et al. ..... 28/107
5,802,682 A * 9/1998 Jourde et al. ..... 28/107
5,819,383 A * 10/1998 Jourde et al. ..... 28/107
6,305,058 B1 * 10/2001 Fehrer ..... 28/107
6,779,236 B2 * 8/2004 Fehrer ..... 28/107
2003/0000056 A1 * 1/2003 Fehrer ..... 28/247

* cited by examiner

*Primary Examiner*—Amy B. Vanatta
(74) *Attorney, Agent, or Firm*—Collard & Roe, P.C.

(57) ABSTRACT

An apparatus is described for needling a non-woven material (1) with at least one needleboard (15) which is drivable in a reciprocating manner in the needle-penetration direction and with a stitch base which is opposite of the needleboard (15) and is made of a continuously revolving brush belt (5) forming a conveyor for the non-woven material (1). In order to provide advantageous constructional conditions it is proposed that the needleboard (15) comprises rows of needles which have an even distance of the rows and extend in at least in one section in the revolving direction (11) of the brush belt (5), and that the brush belt (5) and the needleboard (11) can be moved back and forth in a reciprocating manner by means of a traversing drive (20) during the conveyance of the non-woven material transversally to the revolving direction (11) of the brush belt (5) to an extent corresponding to the distance of the needle rows relative to each other or an integral multiple thereof.

4 Claims, 3 Drawing Sheets

APPARATUS FOR NEEDLING A NON-WOVEN MATERIAL

FIELD OF THE INVENTION

The invention relates to an apparatus for needling a non-woven material with at least one needleboard which is drivable in a reciprocating manner in the needle-penetration direction and with a stitch base which is opposite of the needleboard and is made of a continuously revolving brush belt forming a conveyor for the non-woven material.

DESCRIPTION OF THE PRIOR ART

In order to achieve a marked pile formation during the needling of the non-woven material, the non-woven material is conveyed on a stitch base made of a continuously revolving brush belt through the needling device, so that the needles penetrating the non-woven material needle on the needling exit side needle pile fibers in a loop-forming manner into the brush belt. If this pile formation occurs only in sections, the non-woven material can be provided with a surface pattern formed by the pile fibers. It is necessary to ensure an even wearing of the brush belt, because the surface structures of the brush belt are imaged on the surface of the non-woven during the needling of the non-woven material. For this reason it is not possible in known apparatuses of this kind to needle ribs extending in the revolving direction of the brush belt because rows of needles are required which extend in the revolving direction of the brush belt and which leave longitudinal grooves in the brush belt.

SUMMARY OF THE INVENTION

The invention is thus based on the object of providing an apparatus for needling a non-woven material of the kind mentioned above in such a way that ribs extending in the revolving direction of the brush belt can be needled without having to expect a groove structure of the bearing surface of the brush belt.

This object is achieved by the invention in such a way that the needleboard comprises rows of needles which have an even distance of the rows and extend in at least in one section in the revolving direction of the brush belt and that the brush belt and the needleboard can be moved back and forth in a reciprocating manner during the traversing drive during the conveyance of the non-woven material transversally to the revolving direction of the brush belt to an extent corresponding to the distance of the needle rows relative to each other or an integral multiple thereof.

Since the brush belt and the needleboard are moved in a reciprocating manner relative to each other during the conveyance of the non-woven material transversally to the revolving direction of the brush belt to the extent of the distance of the rows of needles relative to each other, it is possible, despite the arrangement of rows of needles extending in the revolving direction of the brush belt, to ensure a wearing which is evenly distributed over the width of the brush belt as a precondition for the needling of ribs extending in the longitudinal direction of the non-woven material. The mutual distance of the rows of needles must be chosen equally for this purpose. Moreover, the traversing drive must be set in such a way that the displacement of the non-woven material relative to the needleboard which is linked to the movement of the brush belt reciprocating transversally to the revolving direction does not lead to any disturbing transversal offset of the needled ribs. This is not the case when the forward feed of the traversing operation is small in comparison with the forward feed of the non-woven material in the revolving direction of the brush belt. If a transversal advancement corresponding to a single distance of a row is performed during a circulation of the brush belt, the transversal offset of the needled surface structure of the non-woven material as caused by said transversal offset per unit of length can be neglected because it is not visible.

Since the relative movement between the brush belt and the needleboard transversally to the revolving direction of the brush belt is relevant, several constructional solutions are opened up for the traversing operation. A simple solution is obtained in such a way that the traversing drive comprises at least axially displaceable deflection rollers for the brush belt with guide disks resting on the longitudinal edges of the brush belt, so that in the case of an axial displacement of the deflection roller, the brush belt is entrained transversally to its revolving direction. Another possibility for configuring the traversing drive is to provide a guide table for the strand of the brush belt forming the stitch base, which guide table is displaceable transversally to the revolving direction of the brush belt. The transversal displacement of the brush belt is achieved via the movement of the table.

It is not necessary to move the brush belt per se via the traversing drive transversally to its revolving direction. If the needleboard is provided with its drive on a carriage which is held transversally displaceable to the revolving direction of the brush belt and if it is driven accordingly, comparable conditions are obtained concerning even wearing of the brush belt.

BRIEF DESCRIPTION OF THE DRAWINGS

The subject matter of the invention is shown in the drawings by way of example, wherein.

DESCRIPTION OF THE PREFERRED EMBODIMENTS

Figure 1:
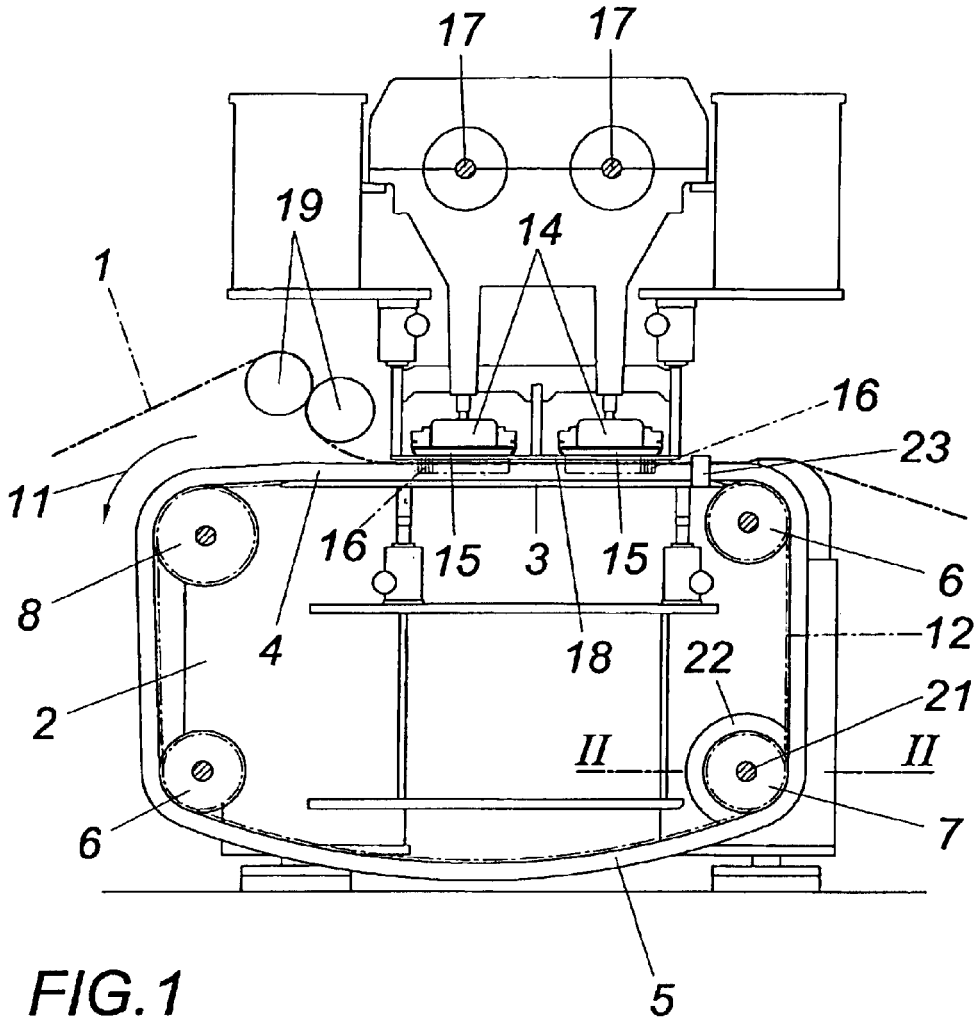
FIG. 1 shows an apparatus in accordance with the invention for needling a non-woven material in a schematic side view.
Figure 2:
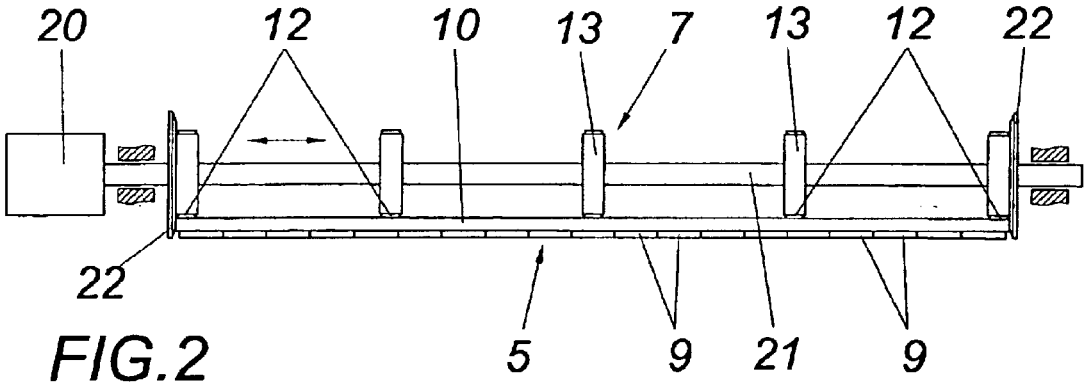
FIG. 2 shows a sectional view along the line 11—11 of FIG. 1 on an enlarged scale.

An apparatus for needling a non-woven material 1 according to the embodiment of FIGS. 1 and 2 comprises a frame 2 with a guide table 3 for the conveying strand 4 of a brush belt 5 which is guided in a continuous way around the deflection rollers 6, 7, 8, of which at least one deflection roller 8 is driven. The brush belt 5 per se is composed of the individual brush bodies 9 which are fastened to support profiles 10. The support profiles 10 which extend transversally to the brush belt are joined to each other in the manner of a flat-link articulated chain and rest on the guide table 3 in the region of the conveying strand 4. The support profiles 10 are provided with toothed belts 12 for the drive of the brush belt 5, which toothed belts mate with respective toothed disks 13 of the deflection rollers 6, 7, 8.

Needleboards 15 which are held in needle beams 14 are opposite of the conveying strand 4 of the brush belt 5, with the needles of the needleboards being designated with reference numeral 16. According to the illustrated embodiment, the two needleboards 15 are arranged successively behind each other in the revolving direction of the brush belt. Said needleboards 15 are conventionally driven in a reciprocating manner via eccentric shafts 17 in the direction of the needle penetration. Strippers 18 are provided between the needleboards 15 and the conveying strand 4 used as a stitch base.

The needles 16 of the needleboards 15 are combined at least in sections in rows of needles which extend in the revolving direction 11 of the brush belt 5 and have a constant mutual distance. During the needling of the non-woven material 1, longitudinal ribs in the form of pile fiber loops needled into the brush belt 5 are therefore produced on the needling exit side facing the brush belt 5. After the needling process, the non-woven material 1 is removed via a pair of rollers 19 by the conveying strand 4 of the brush belt 5.

In order to prevent any formation of grooves in the surface region of the brush belt 5 forming the base for the non-woven material as a result of the rows of needles extending in the revolving direction of the brush belt 5, the brush belt 5 is displaced during its revolving via a traversing drive 20 transversally to the revolving direction 11, as is shown especially in FIG. 2. Said traversing drive 20 is connected with a deflection roller 7 whose axle 21 is held in an axially displaceable way and carries guide disks 22 grasping beyond the longitudinal edges of the brush belt 5. The brush belt 5 can be reciprocated transversally to the revolving direction 11 through said traversing drive 20, namely to an extent which corresponds to the constant distance of the rows of needles or an integral multiple thereof. This measure ensures that despite rows of needles extending in the revolving direction 11 of the brush belt 5 an even wearing of the brush belt 5 is ensured, so that no surface structures are obtained in the region of the brush belt forming the base for the non-woven material which might be imaged during the needling in the non-woven material. For the purpose of controlling the transversal displacement of the brush belt 5, a sensor 23 for the progress of the longitudinal edge of the brush belt 5 is provided. The thus enabled detection of the actual values of the progress of the longitudinal edge allows simply effecting the control of the traversing drive 20.

Figure 3:
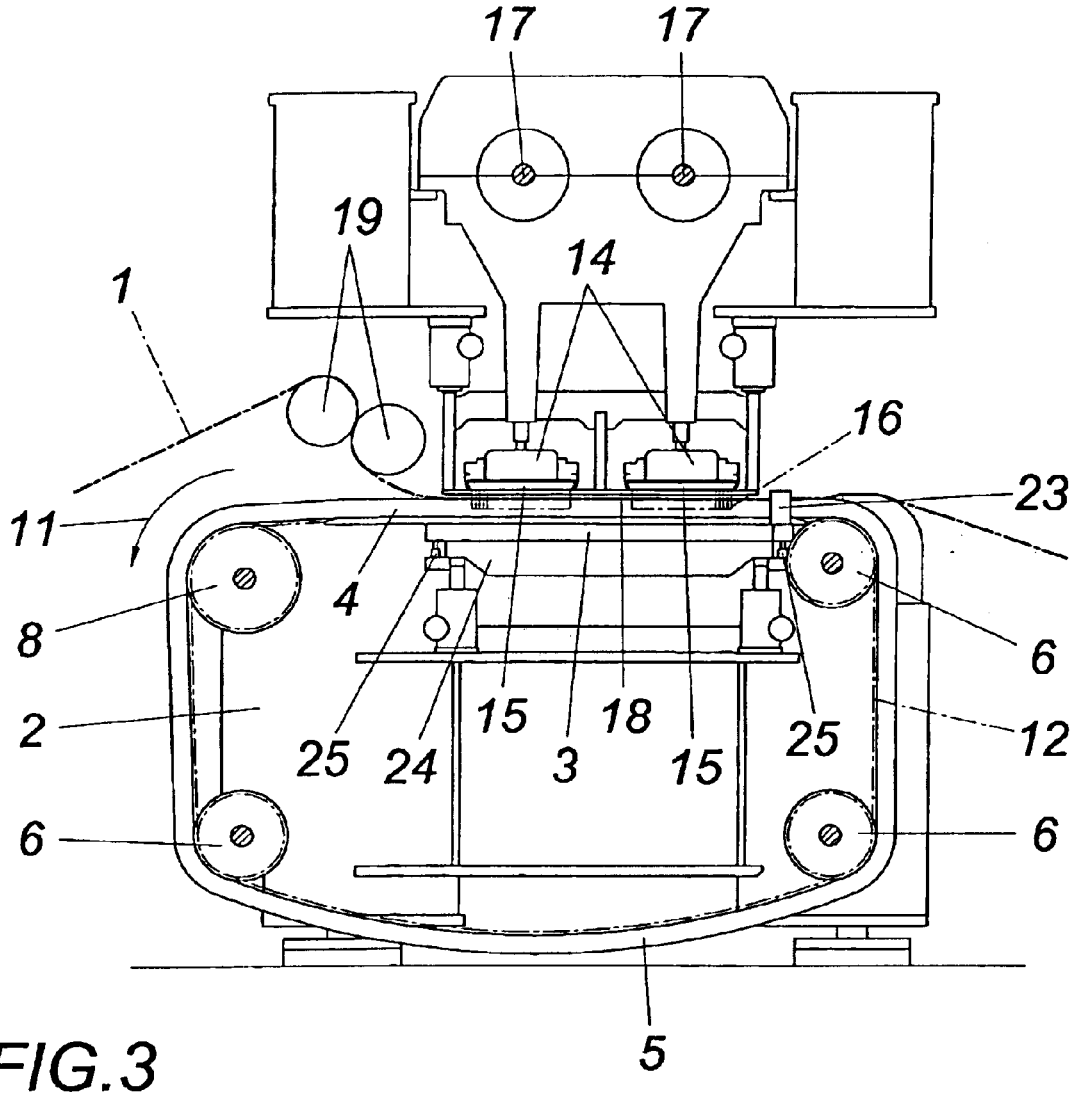
FIG. 3 shows a representation corresponding to FIG. 1 of a constructional variant of an apparatus according to the invention.
Figure 4:
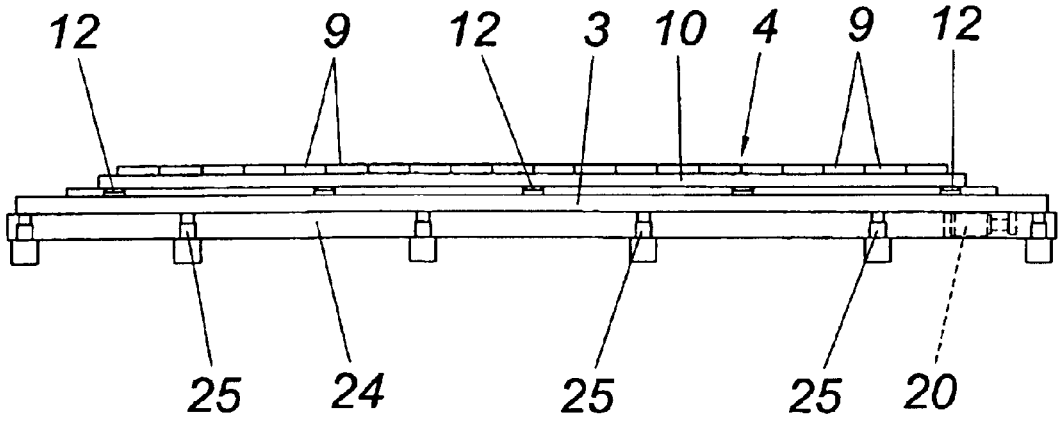
FIG. 4 shows the guide table for the brush belt according to the embodiment according to FIG. 3 in a sectional view in a front view on an enlarged scale.

In contrast to the embodiment according to FIGS. 1 and 2, the brush belt 5 of the apparatus according to FIGS. 3 and 4 is not displaced transversally to the guide table 3, but with the guide table 3. For this purpose the guide table 3 is held on a frame 24, which is fixed to the structure, transversally to the revolving direction 11 of the brush belt 5 and can be displaced relative to said frame 24 with the help of the traversing drive 20. The traversing drive 20 can be activated via a control device connected to the sensor 23 depending on the progress of the longitudinal edge of the brush belt 5. If no traversing movement is desired over the guide table 3, the guide table 3 can be fixed in a non-displaceable manner relative to the frame 24 by a clamping cylinder 25 for example.

Figure 5:
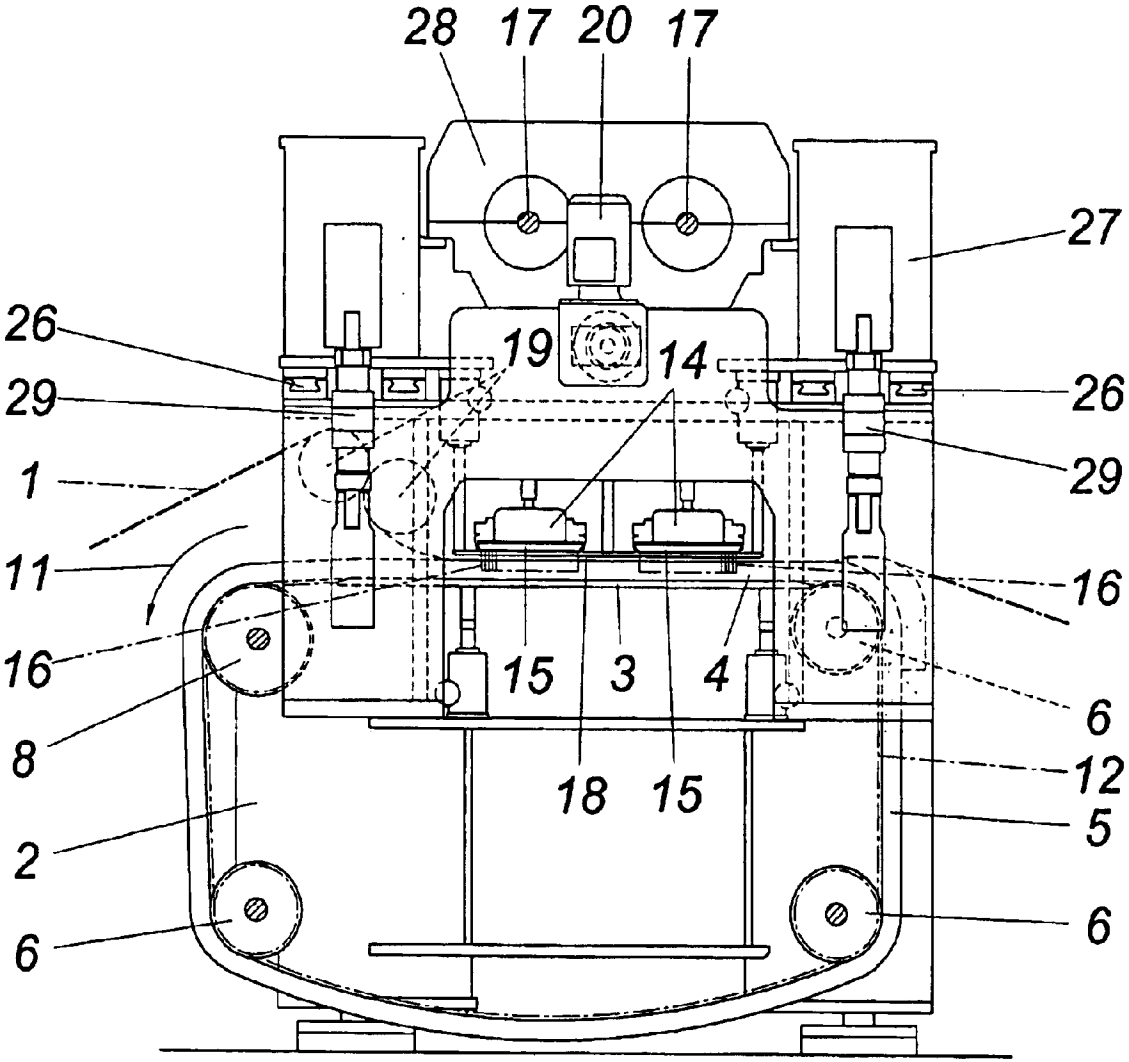
FIG. 5 shows a further constructional variant of an apparatus in accordance with the invention in a schematic side view.

The embodiment according to FIG. 5 shows an apparatus in which it is not the brush belt 5 but the needleboards 15 which are displaced transversally to the revolving direction 11 of the brush belt 5 in order to achieve an even wearing of the brush belt 5 by the needles 16 arranged in longitudinal rows. The frame 2 forms for this purpose guide means 26 for a carriage 27, which guide means extend transversally to the revolving direction 11 of the brush belt 5 and which carriage receives the drives 28 for the needle beams 14 with the eccentric shafts 17 and the strippers 18. The transversal displacement of the carriage 27 is thus also used to ensure a relative movement between the brush belt 6 and the needleboards 15 transversally to the revolving direction 11 of the brush belt 5, so that an even wearing of the brush belt 5 is achieved in the case of a traversing movement to the extent of the constant distance of the rows of needles. It is merely necessary to displace the carriage 27 through the traversing drive 20 accordingly.

In order to operate the apparatus without a traversing movement of the needleboards 15 transversally to the revolving direction 11 of the brush belt 5, the carriage 27 is fixed relative to the frame 2. This can be performed via clamping cylinders 29 according to the illustrated embodiment.

What is claimed is:

1. An apparatus for needling a non-woven material with at least one needleboard which is drivable in a reciprocating manner in the needle-penetration direction and with a stitch base which is opposite of the needleboard and is made of a continuously revolving brush belt forming a conveyor for the non-woven material, characterized in that the needleboard (15) comprises rows of needles which have an even distance of the rows and extend in at least in one section in the revolving direction (11) of the brush belt (5), and that the brush belt (5) and the needleboard (11) can be moved back and forth in a reciprocating manner by means of a traversing drive (20) during the conveyance of the non-woven material transversally to the revolving direction (11) of the brush belt (5) to an extent corresponding to the distance of the needle rows relative to each other or an integral multiple thereof.

2. An apparatus as claimed in claim 1, characterized in that the traversing drive (20) comprises at least one axially displaceable deflection roller (6) for the brush belt (5) with guide disks (22) resting on the longitudinal edges of the brush belt (5).

3. An apparatus as claimed in claim 1, characterized in that the traversing drive (20) comprises a guide table (3) for the conveying strand (4) of the brush belt (5) forming the stitch base, which guide table is displaceable transversally to the revolving direction (11) of the brush belt (5).

4. An apparatus as claimed in claim 1, characterized in that the traversing drive (20) consists of a carriage (27) which receives the needleboard (15) and its drive (28) and can be moved transversally to the revolving direction (11) of the brush belt (5).

* * * * *